US005762846A

United States Patent [19]

Blankenbeckler et al.

[11] Patent Number: 5,762,846

[45] Date of Patent: Jun. 9, 1998

[54] DISPERSION SPINNING PROCESS FOR POLYTETRAFLUOROETHYLENE AND RELATED POLYMERS

[75] Inventors: Nicole Lee Blankenbeckler, Richmond; Joseph Michael Donckers, II, Midlothian; Warren Francis Knoff, Richmond, all of Va.

[73] Assignee: E. I. du Pont de Nemours and Company, Wilmington, Del.

[21] Appl. No.: 770,530

[22] Filed: Dec. 20, 1996

[51] Int. Cl.[6] ..... D01F 6/12

[52] U.S. Cl. ..... 264/127; 264/178 F; 264/187; 264/211.16; 264/233

[58] Field of Search ..... 264/127, 178 F, 264/187, 203, 211.16, 233

[56] References Cited

U.S. PATENT DOCUMENTS

| | | | |
|---|---|---|---|
| 2,772,444 | 12/1956 | Burrows et al. | 264/127 |
| 2,951,047 | 8/1960 | Lantos | 264/127 X |
| 3,055,852 | 9/1962 | Youse | 428/336 |
| 3,078,242 | 2/1963 | Morgan | 524/233 |
| 3,114,672 | 12/1963 | Schott | 162/157.3 |
| 3,118,846 | 1/1964 | Boyer | 264/127 |
| 3,147,323 | 9/1964 | Boyer | 264/211 |
| 3,148,234 | 9/1964 | Boyer | 264/211 |
| 3,242,120 | 3/1966 | Steuber | 524/21 |
| 3,655,853 | 4/1972 | Gallup | 264/127 |
| 3,670,069 | 6/1972 | Mitchell et al. | 264/187 |

FOREIGN PATENT DOCUMENTS

| | | | |
|---|---|---|---|
| 63-126911 | 5/1988 | Japan . | |
| 813332 | 5/1959 | United Kingdom . | |
| 1043871 | 9/1966 | United Kingdom | 264/127 |
| 1407132 | 9/1975 | United Kingdom . | |
| 2 220 881 | 1/1990 | United Kingdom . | |
| 2 284 421 | 6/1995 | United Kingdom . | |

OTHER PUBLICATIONS

G. Mostovykh et al. "Spinning and Investigation of Fibers Based on Low–Substituted Hydroxyethylcellulose Ethers II. Preparation and Investigation of the Physicochemical Properties of Low–Substituted Hydroxyethylcellulose". *Cellulose Chemical Technology*, vol. 19, No. 1, pp. 15–36 (1985).

*Primary Examiner*—Leo B. Tentoni

[57] ABSTRACT

A process for spinning a fully water washed fluorinated olefinic polymer intermediate fiber structure from a mixture of an aqueous dispersion of particles of the fluorinated olefinic polymer and a solution of a cellulosic ether.

7 Claims, 1 Drawing Sheet

DISPERSION SPINNING PROCESS FOR POLYTETRAFLUOROETHYLENE AND RELATED POLYMERS

This invention relates to a process for spinning a dispersion of poly(tetrafluoroethylene) or related polymers into fibers, or for forming such a dispersion into shaped articles in which the final, sintered fluorinated polymer structure, as well as the intermediate structure, are substantially free of process salts, acids and other impurities.

BACKGROUND OF THE INVENTION

The outstanding stability of poly(tetrafluoroethylene) and related polymers on exposure to light, heat, solvents, chemical attack and electrical stresses, makes these polymers and articles made from these polymers desirable for a variety of uses. But because of the complexities involved with melt and solution processing of these polymers, it is very difficult to spin or shape them by conventional methods.

One method which is used to shape or spin poly (tetrafluoroethylene) and related polymers is to shape or spin the polymer from a mixture of an aqueous dispersion of the polymer particles and viscose, where cellulose xanthate is the soluble form of the matrix polymer, as was taught in U.S. Pat. Nos. 3,655,853; 3,114,672; and 2,772,444.

Even though viscose is commonly employed in forming fibers from poly(tetrafluoroethylene) and related polymers, the use of viscose suffers from some serious disadvantages. Viscose is prepared by a complex and time consuming process in which wood pulp is treated with an alkali hydroxide and carbon disulfide. Carbon disulfide is a hazardous chemical. Because of the explosive property of mixtures of carbon disulfide and air, extraordinary care and precautions are required in its handling. It is neither practical nor safe to recover the carbon disulfide that evaporates from the coagulation bath, when by chemical reaction cellulose is regenerated from the viscose (cellulose xanthate). Thus, this hazardous chemical is generally vented to the atmosphere creating environmental concerns as well as increasing the cost of viscose manufacture.

Alternatives to a viscose forming are known, but the use of these matrix polymers have also generally involved the use of an organic solvent, a surfactant, or both, such as was taught in U.S. Pat. Nos. 3,147,323; 3,118,846 and 2,951,047.

U.S. Pat. No. 3,242,120 to Steuber taught a self supporting gel structure and a method for spinning or forming shaped articles from aqueous dispersions of water insoluble polymer particles mixed with a water soluble matrix polymer such as sodium alginate or poly(vinyl alcohol). This mixture formed a gel structure when it was contacted with a coagulation medium which gelled the matrix polymer. Although Steuber listed compounds that might serve as matrix polymers and taught washing of the fiber formed from the gel structure after polymer particles coalescence, Steuber did not teach or suggest how one might make an intermediate fiber that is free from salts and other impurities.

During dispersion spinning or forming, ions from the coagulation bath become incorporated into the intermediate structure. These ions, for example hydrogen, sodium and sulfate ions, may cause serious problems in conversion of the intermediate fiber structure into the finished, sintered (coalesced) fluorinated olefinic polymer fiber.

The typical coagulation bath used in dispersion forming is an acid bath containing sulfuric acid and sodium sulfate. Acid residue from the sulfuric acid cause the intermediate fiber structure to degrade under the temperature conditions necessary to coalesce the fluorinated polymer. The presence of salt, which may sometimes accumulate to levels as high as 25% by weight of the fiber structure, is likely to produce a fiber with unacceptable mechanical strength. In most cases a high concentration of salt in the intermediate fiber structure may even prevent the formation of a sintered fiber since it is very difficult, if not impossible, to sinter the intermediate fiber structure containing residual salt.

It is an object of the present invention to provide a process from which poly(tetrafluoroethylene) and related polymers may be formed into intermediate shaped articles or spun into fibers which can be easily washed free of the accumulation of processing ions and other impurities and then worked into final, sintered products.

Another object of the present invention is to provide a process for making shaped articles from aqueous dispersions of poly(tetrafluoroethylene) and related polymers which has the advantages of the viscose based process, but is free of the disadvantages associated with the use of cellulose xanthate as the soluble matrix polymer.

SUMMARY OF THE INVENTION

The present invention provides a process for spinning a fully water washed fluorinated olefinic polymer intermediate fiber from a mixture of an aqueous dispersion of particles of the fluorinated olefinic polymer and a solution of a matrix polymer comprising the steps of:

(a) forming a mixture of the aqueous dispersion of the fluorinated olefinic polymer particles and the solution of the matrix polymer wherein the matrix polymer is a cellulosic ether having a degree of substitution that is no more than about 0.5 and no less than about 0.02;

(b) extruding the mixture into a coagulation solution containing salts, acids or mixtures thereof to coagulate the matrix polymer and to form an intermediate fiber structure; and (c) washing the intermediate fiber structure in sufficient near neutral pH water to substantially remove from the fiber structure salts, acids and mixtures thereof wherein the washed fiber structure has a self supporting length of at least 30 cm and is substantially free of ions.

The intermediate fiber structure of the present invention may be converted to a coalesced fluorinated olefinic polymer fiber by subjecting the intermediate fiber structure to the additional steps following (c) of drying and sintering the fiber structure to oxidize the matrix polymer and to coalesce the fluorinated olefinic polymer particles.

The present invention also provides an improved intermediate fiber structure consisting essentially of a mixture of particles of a fluorinated olefinic polymer, a coagulated matrix polymer and water wherein the ratio of the weight of the polymer particles to that of the matrix polymer in the intermediate fiber structure is from about 3 to 1 to about 20 to 1 and wherein the matrix polymer is a cellulosic ether having a degree of substitution that is no more than about 0.5 and no less than about 0.02 and wherein the matrix polymer forms with the fluorinated polymer particles a washed fiber structure having a self supporting length of at least 30 cm and that is substantially free of ions.

BRIEF DESCRIPTION OF THE DRAWINGS

The FIGURE illustrates syringe spinning for testing the integrity of intermediate fiber structures.

DETAILED DESCRIPTION

Figure 1:
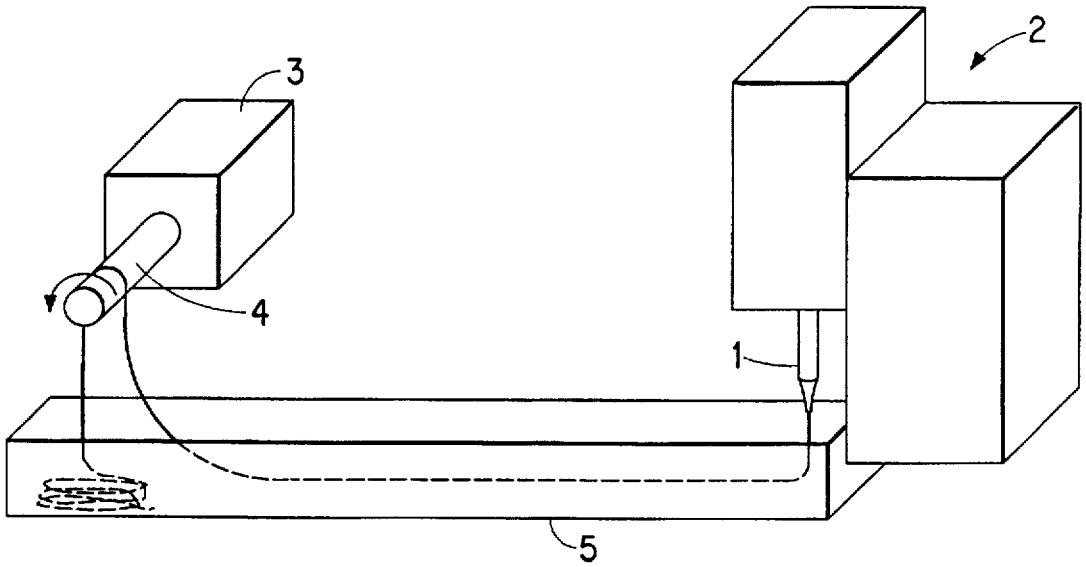

As used herein, the term poly(tetrafluoroethylene) and related polymers means poly(tetrafluoroethylene) and polymers generally known as fluorinated olefinic polymers, for example, co-polymers of tetrafluoroethylene and hexafluoropropene (FEP), co-polymers of tetrafluoroethylene and perfluoroalkyl-vinyl ethers such as perfluoropropyl-vinyl ether (PFA) and perfluoroethyl-vinyl ether, fluorinated olefinic terpolymers including those of the above-listed monomers and other tetrafluoroethylene based co-polymers.

As used herein the term PTFE means poly (tetrafluoroethylene).

As used herein the term aqueous dispersion means a particle dispersion made in water which may contain various surface active additives and additives for adjustment of pH and maintaining the dispersion.

As used herein below, intermediate fiber structure means the extruded and coagulated mixture of the matrix polymer solution and the polymer particle dispersion. The intermediate fiber structure of the present invention has a self supporting to a length of at least 30 cm after being washed substantially free of ions and impurities. The intermediate fiber structure of the present invention, after washing in near neutral pH water to substantially remove ions and impurities, shows no substantial loss of strength or integrity, and may be worked, for example drawn at a modest draw ratio, and sintered to form a final, coalesced fluorinated polymer fiber or shaped article. The intermediate fiber structure of the present invention may be isolated, worked in subsequent processing or used for producing fabrics or batts as is known in this art.

As will be understood by one skilled in this art, intermediate fiber structure includes, as well as typical fiber monofilament and fiber bundle structures, tapes, ribbons, films and the like.

By the term dispersion forming is meant the process by which a dispersion of insoluble polymer particles is mixed with a solution of a soluble matrix polymer, and this mixture coagulated by contacting the mixture with a coagulation solution in which the matrix polymer becomes insoluble.

Dispersion forming, generally known as dispersion spinning for fiber articles, is useful in producing shaped articles from fluorinated polymers. These polymers, which are difficult to form by melt extrusion or solution spinning, may be successfully spun from a mixture of an aqueous dispersion of fluorinated polymer particles mixed with a solution of a suitable matrix polymer. An intermediate structure is formed when this mixture is contacted with a suitable coagulation bath. Although the intermediate structure is mechanically sound, a final, sintered structure is generally formed by heating the intermediate structure to a temperature sufficient to coalesce the fluorinated polymer particles. On sintering the matrix polymer decomposes to form volatile gases and a carbonaceous residue.

In order to achieve useful coalesced fluorinated olefinic polymer fibers, it is essential to wash the intermediate fiber structure free of ions absorbed from the coagulation bath as well as to remove other impurities such as additives and/or dispersants that were present in the initial fluoropolymer dispersion and to remove materials that are detrimental to fiber sintering and/or the properties of the final, coalesced fluorinated polymer fiber.

It is known that the selection of a matrix polymer is not straight forward nor that the performance of such a polymer is predictable from properties of fibers spun from typical spin solutions of the candidate matrix polymer.

In the present invention the composition of the intermediate fiber structure has a cellulosic ether present as only a minor constituent of the fiber solids, while the major constituent is fluorinated polymer particles having a weight in the intermediate fiber structure that may be from 3 to 20 times that of the matrix polymer. The fact that a particular cellulosic compound can be spun as a fiber, under more or less ideal conditions, does not provide a measure of the necessary cohesive property that must characterize the matrix polymer in order that it can provide the necessary support and structure to make a workable intermediate fluoropolymer fiber structure. Examples 3 and 4 below illustrate this point.

In order for the intermediate fiber to be water washable, the matrix polymer must have precisely defined properties of insolubility in water which is near neutral in pH and at process temperatures. Without the ability to wash the intermediate fiber structure in water that is essentially free of ions, such as near neutral pH water, the intermediate fiber can not be made substantially free of the harmful impurities that may prevent the formation of a useful fluorinated fiber on sintering.

In addition, it is preferred that the matrix polymer neither soften or melt at a temperature substantially below that of sintering, otherwise the intermediate fiber structure may stretch, weaken or break under its own weight as it is heated to sintering temperatures.

The cellulose xanthate matrix forming process has some serious disadvantages in that to form the cellulose xanthate requires the use of carbon disulfide, a toxic and extremely flammable substance. Viscose also does not form a stable solution. The viscose solution will spontaneously gel as it ages. In commercial viscose based forming processes, the spontaneous gelling of the viscose is a very real process problem resulting in waste and the requirement for extensive line flushing and tank cleaning.

The inventors of the present invention wanted to find a substitute for the cellulose xanthate matrix forming process that possessed the advantages of the viscose forming process and yet avoided the serious disadvantages. They discovered that cellulosic ethers having a uniform degree of substitution, and which are soluble in only strong aqueous alkali hydroxide, but insoluble in near neutral pH water provided matrix polymers that met the requirements of the present invention. By the term near neutral pH water is meant water having a pH from about 6 to 8.

The structural features that are strongly related to solubility of the cellulosic ethers are the functionality of chemical substituents in the cellulose ethers and the degree of substitution. By degree of substitution (DS) is meant the extent to which the hydroxyl groups of a cellulose molecule have been replaced with ether functional groups.

In a cellulose molecule, there are three hydroxyl groups on each anhydroglucoside ring. If all three of these hydroxyl groups have been replaced, the DS is 3, the maximum degree of substitution.

The cellulose ethers used in the process of the present invention are those cellulosic ethers which are soluble only at high concentrations of sodium hydroxide in water and insoluble in near neutral pH water in the temperature range of 10° to 90° C. Of the cellulosic ethers possessing these solubility characteristics, the nonionic cellulosic ethers are preferred matrix polymers. In addition the matrix polymers of the present invention have no softening or melting point. These polymers decompose at temperatures near the sinter temperature of the fiber providing structure up to coalescence of the fluoropolymer.

The inventors found that to provide an intermediate structure that could be washed substantially free of salts and other impurities, it was necessary to use only those cellulosic ethers that were insoluble in near neutral water and which provided after washing an intermediate fiber structure having a self supporting length of at least 30 cm. Although many materials may form a gel structure, as is illustrated by the listing provided in Steuber, col. 13, only the combination of solubility in a solution having a concentration of sodium hydroxide greater than about 1.3 molar (greater than about 5% by weight having a calculated pH of more than 14) and insolubility of the coagulated matrix polymer in near neutral water provide the essential features of the matrix polymer of the present invention. Without this combination of properties, the intermediate fiber structure will not possess the property of full water washability, neither will acceptable strength properties of the sintered fiber be assured.

Nonionic cellulosic ethers, such as hydroxypropylcellulose and hydroxyethylcellulose, provide particularly good spinning compositions for dispersion spinning of fluorinated polymers. DS values that are representative of the matrix polymers of the present invention are values that range from about 0.02 to 0.5. Uniformity of substitution for the matrix polymers of the present invention is preferable, and is indicated by transparency of the solution formed in about 10% by weight aqueous sodium hydroxide.

The matrix solution of any of the matrix polymers of the present invention or mixtures thereof, may be prepared by dissolving the particular cellulosic ether in a solution of about 5 to 10% by weight sodium hydroxide. The low DS required for the present invention makes it necessary to use a much higher pH than was known in the prior art.

For hydroxypropylcellulose matrix polymer, a material characterized by having a viscosity of at least 90 mPa.sec when dissolved at 2% by weight in 10% sodium hydroxide solution and measured at 25° C. is preferred, although solutions of lower viscosity material may be successfully spun or formed.

It is preferred to form the shaped articles of the present invention by extruding the mixture of the matrix polymer solution and the fluorinated particle dispersion into a coagulation liquid which rapidly gels the article. The formed article may then be washed and further processed. The composition of coagulation liquids depends, to some extent, on the particular matrix polymer being used. Useful coagulation liquids include a large variety of aqueous solutions typified but not limited to 40% ammonium acetate—5% acetic acid, 30% acetic acid, or 30% calcium chloride. Of particular value for the cellulose ethers of this invention is a 5% sulfuric acid—18% sodium sulfate solution. The temperature of the coagulation bath can be adjusted to that which provides the best properties for the intermediate fiber structure, and is typically in the range of 25° C. to 90° C. For the materials of this invention a coagulation bath temperature of 40° C. to 60° C. is preferred.

It is preferred to adjust the temperature of the wash water to maximize the strength of the intermediate fiber structure. Matrix polymers of the present invention are generally insoluble in water at approximately 20° C. or higher. However, a washing temperature of about 50° C. is recommended to provide conditions of increase polymer insolubility and to speed the washing process for commercial operation.

The intermediate fiber of the present invention was washed substantially free of ions and impurities with no substantial loss of strength. By the term substantially free of ions and impurities is meant that the pH and conductivity of deionized wash water was unchanged after dipping the intermediate fiber into the water. The self supporting length of the washed intermediate fiber was at least 30 cm. Although tenacity of several intermediate fiber structures is reported below, the actual tenacity required to provide a self supporting length of 30 cm varies with the water content of the fiber. Thus, the self supporting length of the intermediate fiber is a more practical definition of the sufficiency of fiber strength than a particular range in tenacity.

The spinning or forming compositions used in the process of the present invention are made by mixing an aqueous dispersion of fluorinated polymer particles with a solution of the matrix polymer of the present invention. Aqueous dispersions of fluorinated olefinic polymer particles, such as those known in the art may be used in the present process. The solutions of matrix polymer need to be clear and of a viscosity that assures good mixing with the dispersion. Preferably the concentration of matrix polymer in the solution is from 3 to 10% by weight. These components are then mixed such that the ratio of the weight of the polymer particles to that of the matrix polymer in the intermediate fiber structure is from about 3 to 1 to about 20 to 1, and preferably about 9 to 1.

The matrix polymer solutions of the present process are stable and do not gel with age. There is no need for constant agitation or precise temperature control of the solutions. Although the composition of the present invention is also stable on storage, it is preferred that the matrix polymer solution and the fluorinated polymer dispersion be, according to common practice in this art, mixed immediately before use to ensure that this mixture is uniform and that the particles of the fluorinated polymer dispersion do not settle.

The present invention also provides a process of forming intermediate and finished fluorinated polymer article, such as films, tapes, ribbons and fibers of various shapes, from an aqueous dispersion of fluorinated polymer particles comprising the steps of:

(a) forming a mixture of the aqueous dispersion of the fluorinated olefinic polymer particles and the solution of the matrix polymer wherein the matrix polymer is a cellulosic ether having a degree of substitution that is no more than about 0.5 and no less than about 0.02 and wherein the matrix polymer forms with the fluorinated polymer particles a washed intermediate article that is substantially free of ions;

(b) extruding the mixture into a coagulation solution containing salts, acids or mixtures thereof to coagulate the matrix polymer and to form the intermediate article; and (c) washing the intermediate article in sufficient near neutral pH water to substantially remove from the fiber structure salts, acids or mixtures thereof and other impurities.

The intermediate article may then be finished by subjecting it to additional steps following (c) of drying and sintering to oxidize the matrix polymer and to coalesce the fluorinated olefinic polymer particles.

TEST METHODS

Polymer Viscosity

Polymer solution viscosity was measured as follows:

A sample of the solution for which the viscosity was to be measured was filtered and placed in a vacuum chamber and kept under vacuum until traces of air bubbles were no longer visible. Enough sample was transferred into a 600 ml beaker to fill the beaker to a depth of 10 cm. The sample was then placed in a constant temperature bath set at 25° C. until the temperature was constant throughout the sample.

Viscosity was measured using a Brookfield model HB-T viscometer. The 600 ml beaker containing sample was placed under the viscometer, and a #2 spindle was attached to the viscometer. The height of the viscometer was adjusted until the surface of the fluid reached the notch on the spindle shaft, and the position of the beaker was adjusted until the spindle was centered in the sample. The viscometer was turned on so that the spindle began turning and the resulting viscosity and temperature were recorded.

The recorded Brookfield reading was converted to a viscosity by applying the appropriate ISO 9002 approved Brookfield factor finder determined from spindle number, RPM's and Brookfield reading.

Intermediate Fiber Strength

The strength of the intermediate fiber structure was determined as follows:

A solution of matrix polymer was prepared at a concentration such that the reported Brookfield viscosity (measured as described above) was between 3000–7000 MPa.sec at 25° C. This solution was then dearated by either placing it under vacuum until all bubbles were gone or allowing the solution to stand for approximately 24 hours or until all bubbles were gone. The solution was then mixed with PTFE dispersion so that the weight ratio of the polymer solids by weight of PTFE to 1 part by weight matrix polymer was from 3 to 20. A typical dispersion contained 60% total polymer solids and was at a PTFE to matrix polymer ratio of 9 to 1. Preferred particle size for the PTFE particles is from about 0.1 to about 0.17 micrometers, such as is present in DuPont type 3311.

This freshly made mixture was then injected by means of a syringe 1 as is illustrated in the FIGURE into (needle tip under surface of the liquid) an appropriate coagulation liquid at a rate of about 1 ml/minute. The composition of the coagulation liquids varied in response to the properties of the particular intermediate fiber structure properties. Optimum of the coagulation liquid composition and temperatures was determined individually by experimentation for each matrix polymer tested.

As shown in the FIGURE, a syringe 1, 3 cc in volume and fitted with a 20 gauge needle, was connected to a syringe pump 2. A constant speed rotating cylinder 4, driven by a motor 3, (surface speed about 2 m/min) was used to pull the intermediate fiber structure through the coagulation liquid in container 5 ensuring a uniform fiber diameter. The intermediate fiber structure was allowed to fall back into the coagulation liquid after passing over the rotating cylinder.

The intermediate fiber structure was then washed in near neutral water to free it of salts and remove residual ions. The fiber was washed by dipping it deionized water which was in a container. Before and after each immersion of the fiber into the water, the pH and conductivity of the water was checked. The water was discarded after each immersion and replaced with fresh deionized water. The fiber was washed until the pH and conductivity of the wash water matched that of the fresh deionized water.

The linear density (denier=gms/9,000 meters length) of the intermediate fiber was measured by determining the weight of a dried length of the fiber. Typically a strand of fiber approximately 0.3 meters in length was used, thus the dry weight of 0.3 meter length×30,000 provided the denier. Three determinations were made and averaged for each strand.

The break load of the washed wet intermediate fiber structure was determined by mounting a fiber sample on a paper specimen, and testing the fiber strength in a suitable mechanical testing instrument (for example, an Instron) at 100 mm/min. cross head speed. Values shown in Table I are the average of five determinations and are normalized for the linear density (for example mg/denier).

Sintered Fiber Tenacity

Sintered fiber tenacity was determined as specified in ASTM Method D 2256-90.

EXAMPLES

Using the previously described test method for determining intermediate fiber strength, the following samples 1–15 were tested.

Table 1 shows a listing of the identity of the matrix polymer tested, the DS, the weight percent concentration of the matrix polymer in the polymer solution, the viscosity of the matrix polymer solution at 25° C., the weight ratio of PTFE to matrix polymer solids in the intermediate fiber, the composition of the coagulation liquid and the strength determination of the intermediate fiber structure.

The weight ratio of the PTFE to that of the matrix polymer is determined by dividing the weight of the polymer particle solids by the weight of the matrix polymer solids in the spin mixture. Since as the fiber is extruded into the coagulation bath all the polymer solids are converted into fiber solids, this same ratio is representative of the composition of the intermediate fiber structure.

TABLE 1

Examples 1–15

| Matrix | EXAMPLE NO. | D.S. | % Matrix | Viscosity, MPa · sec at 25° C. | PTFE: Matrix Ratio | Coagulant | Washed Fiber Strength, mg/denier (D.I. water wash to pH–7–25° C.) |
|---|---|---|---|---|---|---|---|
| Methyl Cellulose[1] | 1 | 1.4 to 1.95 | 3.9 in water only | 4480 | 9:1 | 18% $Na_2SO_4$ 5% $H_2SO_4$ @ 35° C. | 0, not strong enough to test |
| Hydroxypropylmethyl cellulose[2] | 2 | >1.2 | 3.4 in water only | | 9:1 | 18% $Na_2SO_4$ 5% $H_2SO_4$ @ 60° C. | 0, not strong enough to test |
| Carboxymethyl cellulose[3] | 3 | 0.29 | 6.0 | 4978 | 9:1 | 18% $Na_2SO_4$ 5% $H_2SO_4$ @ 50° C. | 0, not strong enough to test |
| Carboxymethyl cellulose[3] | 4 | 0.29 | 6.0 | 6420 | 0[4] | 18% $Na_2SO_4$ 5% $H_2SO_4$ @ 25° C. | 8.5 |

TABLE 1-continued

Examples 1–15

| Matrix | EXAMPLE NO. | D.S. | % Matrix | Viscosity, MPa · sec at 25° C. | PTFE: Matrix Ratio | Coagulant | Washed Fiber Strength, mg/denier (D.I. water wash to pH–7–25° C.) |
|---|---|---|---|---|---|---|---|
| Hydroxyethyl cellulose[5] | 5 | 1.0 | 2.0 | 3520 | 9:1 | 18% $Na_2SO_4$ 5% $H_2SO_4$ @ 50° C. | no fiber formed in the coagulation bath |
| Hydroxyethyl cellulose[5] | 6 | 1.0 | 2.0 | 3520 | 9:1 | sat. $Na_2SO_4$ @ 50° C. | no fiber formed in the coagulation bath |
| Hydroxyethyl cellulose[6] | 7 | 0.5[7] | 4 | 4499 | 9:1 | 18% $Na_2SO_4$ 5% $H_2SO_4$ @ 50° C. | 0.54 |
| Hydroxyethyl cellulose[6] | 8 | 0.5[7] | 4 | 4499 | 9:1 | sat. $Na_2SO_4$ @ 50° C. | no fiber formed in the coagulation bath |
| Hydroxypropyl cellulose[8] | 9 | MS[9] | 5.5 | 5574 | 9:1 | 18% $Na_2SO_4$ 5% $H_2SO_4$ @ 50° C. | no fiber formed in the coagulation bath |
| Hydroxypropyl cellulose[8] | 10 | MS[9] | 5.5 | 5574 | 9:1 | 10% HAc @ 50° C. | no fiber formed in the coagulation bath |
| Hydroxypropyl cellulose[10] | 11 | 0.2 | 6 | 5500 | 9:1 | 18% $Na_2SO_4$ 5% $H_2SO_4$ @ 50° C. | 1.1 |
| Hydroxypropyl cellulose[10] | 12 | 0.2 | 6 | 5500 | 9:1 | 10% HAc @ 50° C. | 0.75 |
| Hydroxypropyl cellulose[10] | 13 | 0.2 | 6 in 13% NaOH | 9225 | 20:1 | 18% $Na_2SO_4$ 5% $H_2SO_4$ @ 50° C. | 0.15 |
| Hydroxypropyl cellulose[11] | 14 | 0.18 | 6 | 3533 | 9:1 | 10% HAc @ 50° C. | 1.7 |
| Hydroxypropyl cellulose[11] | 15 | 0.18 | 6 | 3533 | 9:1 | 18% $Na_2SO_4$ 5% $H_2SO_4$ @ 50° C. | 1.2 |

Unless noted otherwise all solutions of the matrix polymer were in 10% aqueous NaOH.

[1] Available from Dow as Methocel A4C methylcellulose.

[2] Available from Hercules as Primaflo, hydroxypropylmethylcellulose.

[3] Received from Akzo Nobel as an experimental sample 40-C LDS.

[4] 100% by weight matrix solution; no fluorinated polymer particles were present.

[5] Available from Union Carbide as Cellosize QP-4400H, hydroxyethylcellulose.

[6] Union Carbide experimental sample, low EO MS Cellosize HEC 19636-37, hydroxyethylcellulose. EO MS means ethylene oxide maximum substitution.

[7] Ethylene oxide molar substitution is reported; at the particular level of substitution this value is essentially the same as the DS.

[8] Available from Hercules as Klucel G hydroxypropylcellulose, MS = 4.6.

[9] Maximum molar substitution, MS, of 4.6 was provided by the manufacturer; an equivalent DS was not available.

[10] Available from Shin-Etsu as HT-A, hydroxypropylcellulose.

[11] Available from Shin-Etsu as LH-22, hydroxypropylcellulose.

These Examples illustrate the importance of the DS value of the cellulosic ether used as a matrix polymer. The washed fiber strength reported shows the measured tensile strength of fibers formed. "Not strong enough to test" means that a fiber was formed in the coagulation bath, but the fiber disintegrated on handling. In cases where the DS is outside of that of the present invention, either no fiber was formed in the coagulation bath or the fiber formed could not be isolated.

EXAMPLES 16–20

A solution was prepared by slurrying 1.9 kg of the hydroxypropylcellulose (HPC) of Examples 11, 12 and 13, above, in 15.8 liters of soft water at about 25° C. After the HPC was wetted out, 12.3 kg of 23% sodium hydroxide solution was added to the water/HPC mixture. The resulting mixture was stirred under vacuum (about 29 mm Hg) for 1 hour and then was filtered through 50 μm polypropylene felt bag filter into a thin film deaerator operating at about 29 mm Hg vacuum. The resulting solution had a viscosity of 4,800 mP.sec at 25° C. A stream of the above solution merged with a stream of TEF 3311 poly (tetrafluoroethylene) [PTFE] dispersion (available from DuPont de Nemours and Company, Wilmington, Del.) at relative rates such that the ratio of PTFE solids to HPC solids by weight was 8.2 and mixed in an in-line static mixer. The resulting mixture was then pumped through a spinneret containing 180 holes (6 mil diameter) submerged under the surface of a coagulation bath. The coagulation bath composition was 5% sulfuric acid and 18% sodium sulfate. Its temperature was held at 55°±3° C. The resulting fibers were then passed through a wash bath of soft water held at 58°±5° C. and then onto a set of rotating hot rolls. The surface temperature of these rolls was held at 130°±5° C. to dry the fiber. The yarn was passed to another set of rotating hot rolls. The surface temperature of these rolls was held at 363° C.±5° C. to sinter the fiber. The yarn was passed to a set of unheated "draw rolls" on which multiple wraps were placed. The speed difference between the second set of hot rolls and the "draw rolls" was such that the yarn was drawn 6.62 times. This is known as the draw ratio. From the draw roll the yarn was wound on a paper tube. The resulting yarn had a linear density of 1233 dtex. Its tenacity was 1.76 g/dtex.

Data for Example 16 to 20 is presented in Table II. In Examples 17 to 20 fiber was produced as in Example 16 except the draw ratio was as is reported in Table 2.

TABLE 2

Examples 16–20

| Example # | Draw Ratio | Linear density, dtex | Tenacity, g/dtex |
|---|---|---|---|
| 16 | 6.62 | 1233 | 1.76 |
| 17 | 7.18 | 1154 | 1.95 |
| 18 | 7.73 | 1033 | 2.03 |
| 19 | 8.28 | 1053 | 1.84 |
| 20 | 8.83 | 924 | 1.91 |

COMPARATIVE EXAMPLE 21

A solution of 5.4% cellulose xanthate in 5% sodium hydroxide (viscose) was made by reacting wood pulp with sodium hydroxide and carbon disulfide. The resulting solution had a viscosity of 5,400 mPa.sec at 25° C. A stream of the above solution merged with a stream of TEF-3311 poly(tetrafluoroethylene) [PTFE] dispersion at relative rates such that the ratio of weight of PTFE solids to the weight of viscose solids was 8.2 and mixed in an in line static mixer. The resulting mixture was then pumped through a spinneret containing 180 holes (6 mil diameter) submerged under the surface of a coagulation bath. The coagulation bath composition was 5% sulfuric acid and 18% sodium sulfate. Its temperature was held at 59°±3° C. The resulting fibers were then passed through a wash bath of soft water held at 46°±5° C. and then onto a set of rotating hot rolls. The surface temperature of these rolls was held at 210° C.±5° C. to dry the fiber. The yarn was passed to another set of rotating hot rolls. The surface temperature of these rolls was held at 360° C.±5° C. to sinter the fiber. The yarn was passed to a set of unheated "draw rolls" on which multiple wraps were placed. The speed difference between the second set of hot rolls and the "draw rolls" was such that the yarn was drawn 6.1 times. This is known as the draw ratio. From the draw roll the yarn was wound on a paper tube. The resulting yarn had a linear density of 750 dtex. tenacity was 1.40 g/dtex.

What is claimed is:

1. A process for spinning a fully water washed fluorinated olefinic polymer intermediate fiber from a mixture of an aqueous dispersion of particles of the fluorinated olefinic polymer and a solution of a matrix polymer comprising the steps of:

(a) forming a mixture of the aqueous dispersion of the fluorinated olefinic polymer particles and the solution of the matrix polymer wherein the matrix polymer is a cellulosic ether having a degree of substitution that is no more than about 0.5 and no less than about 0.02;

(b) extruding the mixture into a coagulation solution containing salts, acids or mixtures thereof to coagulate the matrix polymer and to form an intermediate fiber structure; and (c) washing the intermediate fiber structure in sufficient near neutral pH water to substantially remove from the fiber structure salts, acids and mixtures thereof wherein the washed fiber structure has a self supporting length of at least 30 cm and is substantially free of ions.

2. The process of claim 1 wherein the matrix polymer is hydroxypropylcellulose, or hydroxyethylcellulose.

3. The process of claim 1 where in the intermediate fiber structure is subjected to additional steps following (c) of:

(d) drying; and (e) sintering to oxidize the matrix polymer and to coalesce the fluorinated olefinic polymer particles.

4. The process of claim 1 wherein the fluorinated olefinic polymer is selected from the group consisting of poly (tetrafluoroethylene), co-polymers of tetrafluoroethylene and hexafluoropropene, co-polymers of tetrafluoroethylene and perfluoroalkyl-vinyl ethers, and fluorinated olefinic ter-polymers from these monomers.

5. The process of claim 1 or 3 wherein the matrix polymer is hydroxypropylcellulose and the fluorinated olefinic polymer is poly(tetrafluoroethylene).

6. A process for forming a fully water washed fluorinated olefinic polymer intermediate article from a mixture of an aqueous dispersion of particles of the fluorinated olefinic polymer and a solution of a matrix polymer comprising the steps of:

(a) forming a mixture of the aqueous dispersion of the fluorinated olefinic polymer particles and the solution of the matrix polymer wherein the matrix polymer is a cellulosic ether having a degree of substitution that is no more than about 0.5 and no less than about 0.02;

(b) extruding the mixture into a coagulation solution containing salts, acids or mixtures thereof to coagulate the matrix polymer and to form the intermediate article; and (c) washing the intermediate article in sufficient near neutral pH water to substantially remove from the fiber structure salts, acids or mixtures thereof and other impurities.

7. The process of claim 6 where in the intermediate article is subjected to additional steps following (c) of drying and sintering to oxidize the matrix polymer and to coalesce the fluorinated olefinic polymer particles.

* * * * *